US005479239A

United States Patent [19]

Ishida et al.

[11] Patent Number: 5,479,239

[45] Date of Patent: Dec. 26, 1995

[54] BIPARTITE SHIELD FOR XEROGRAPHIC PRE-TRANSFER CHARGING DEVICE

[75] Inventors: Hideki Ishida; Kazuhiro Mizude; Hisahiro Kato; Tomohiro Tsutano, all of Osaka, Japan

[73] Assignee: Mita Industrial Co., Ltd., Osaka, Japan

[21] Appl. No.: 432,532

[22] Filed: May 1, 1995

[30] Foreign Application Priority Data

Jun. 21, 1994 [JP] Japan ..... 6-138666

[51] Int. Cl.[6] ..... G03G 15/02; G03G 21/18

[52] U.S. Cl. ..... 355/200; 355/210; 355/221; 355/273

[58] Field of Search ..... 355/200, 210, 355/273, 221; 347/138, 152, 155

[56] References Cited

U.S. PATENT DOCUMENTS 5,142,329 8/1992 Nakaya ..... 355/221

FOREIGN PATENT DOCUMENTS 316771 7/1991 Japan ..... 355/273

*Primary Examiner*—Joan H. Pendegrass

*Assistant Examiner*—Sophia S. Chen

*Attorney, Agent, or Firm*—Beveridge, DeGrandi, Weilacher & Young

[57] ABSTRACT

For a pre-transfer charging device provided in image processing apparatus for a xerographic image reproducing machine, a bipartite shield is provided, having a shield upper case mounted in an imaging apparatus first frame, and a shield lower case mounted in an imaging apparatus second frame fitted with a guide at least partially defining a sheet conveyance path into an imaging unit of the imaging apparatus. The imaging unit includes a chargeable photoconductor drum and is mounted in the first frame, which is pivotally joined to the second frame. A bottom exterior surface of the shield lower case serves as a guide partially defining a terminal portion of the sheet conveyance path. A discharge wire is fitted in the shield upper case, extending axially within the pre-transfer charging device, and therein is movable integrally with the shield upper case. During maintenance on the imaging apparatus, the first frame is opened off of the second frame. The discharge wire as the frames are separated moves integrally with the shield upper case and is thus exposed for ease of cleaning and other maintenance. The bipartite shield construction accordingly ensures that the accuracy of the relative positions of the parts forming the terminal portion of the sheet conveyance path is not disturbed when the frames are separated for maintenance access.

8 Claims, 4 Drawing Sheets

BIPARTITE SHIELD FOR XEROGRAPHIC PRE-TRANSFER CHARGING DEVICE

BACKGROUND OF THE INVENTION

1. Field of the Invention

The present invention relates to a pre-transfer charging device for image processing apparatus in xerography applications. In particular the invention relates to construction of a pre-transfer charging device shield provided adjacent an imaging unit that is mounted in a separable frame of image processing apparatus in a xerographic image reproducing machine.

2. Description of Related Art

Xerographic image processing apparatus in photocopiers and facsimile devices will generally be provided with an imaging unit from which a toner-developed image retained on a photoconductive body is transferred onto a copy sheet, whereupon the sheet is conveyed to a fixing unit which heat-fixes the toner image formed superficially on the sheet. Typically, the imaging unit comprises a photoconductor drum as the photoconductive body, and during a xerographic operation, an electrostatic latent image corresponding to an original is formed on the drum cylindrical surface. A drum charging device, an electrostatic image developing device, an image transferring device, a sheet separation device and a cleaning device are located in turn around the photoconductor drum (which assembly, less the image transferring device, will be referred to hereinafter by the term imaging unit).

Further, a copy sheet conveyance path along which fresh copy sheets are supplied to the imaging unit is provided upstream, in terms of the flow of copy sheets through the image processing apparatus, of the imaging unit. A sheet conveyance terminal guide for guiding the sheets into a position between the imaging unit and the image transferring device is provided at an end of the copy sheet conveyance path along the photoconductor drum.

In the example of xerographic photocopiers, a general construction of the machine body main frame will comprise a plurality of separate frames joined so as to be movable relative to one another in order to facilitate maintenance operations. In a clamshell type photocopier, for example, the main frame is divided into an upper frame openable on a lower frame, with the image transferring device, sheet separation device, sheet conveyance guide, and associated components, located in the lower frame, and the imaging unit located in the upper frame.

Moreover, in order to improve the efficiency with which the image transferring device transfers the toner image on the photoconductor drum onto a supplied copy sheet, a pre-transfer charging device can be provided immediately adjacent the drum between the developing device and the sheet conveyance guide. The pre-transfer charging device, which for example can be a discharger wire surrounded by a conductive shield, or a discharging lamp, causes charge under the toner-developed image superficially retained on the photoconductor drum to disappear, thereby improving the efficiency of the succeeding transfer of the toner image onto a sheet by the image transferring device.

In a clamshell type copier equipped as described above, the positioning of the pre-transfer charging device relative to the photoconductor drum must accordingly remain accurate. Therefore, it is preferable to fit the pre-transfer charging device in the upper frame, in which the photoconductor drum is mounted. This configuration, however, inconveniences maintenance in cleaning, since the pre-transfer charging device must be drawn out in total from the upper frame in order to clean its interior.

SUMMARY OF THE INVENTION

An object of the present invention is to facilitate cleaning maintenance of a pre-transfer charging device in xerographic image processing apparatus.

A further object is to ensure high accuracy of position between a bottom exterior surface of the pre-transfer charging device and a sheet conveyance guide, which together define a terminal portion of a copy sheet conveyance path into an imaging unit of xerographic image processing apparatus.

In an image processing apparatus configuration for a compact clamshell photocopier as described in the foregoing, the pre-transfer charging device is disposed over the sheet conveyance path in close proximity to an upper portion of the image transferring device. In particular, the exterior bottom surface of the shield enclosing the pre-transfer charging device is accordingly in a position opposed to the conveyance guide at the end of the copy sheet conveyance path. Design consideration has been given, therefore, to disposing the corresponding elements therein such that the shield bottom surface serves as a terminal upper guide of the sheet conveyance path.

In this case, given that the pre-transfer charging device is fitted into the upper frame as mentioned, the sheet conveyance guide, being mounted in the lower frame, and the pre-transfer charging device shield are separated on each maintenance occasion when the upper frame is opened off the lower frame. When the upper frame subsequently is closed back onto the lower frame, accuracy can be lost in the positioning of the shield bottom surface relative to the conveyance guide, which can result in unsatisfactory transferring of the toner image onto the copy sheet.

Another general xerographic copier construction calls for a subframe, in which the imaging unit is disposed, mounted as a sliding drawer such that it can be withdrawn frontward from within a copier body main frame, holding an image transferring device, sheet separating device and sheet conveyance guide. A pre-transfer charging device included in this construction will be located on the sliding subframe. In this case also, design consideration has been given to a disposition of corresponding parts wherein the bottom exterior surface of the pre-transfer charging device serves to define a terminal upper portion of the copy sheet conveyance path. During maintenance, the pre-transfer charging device is withdrawn in tandem with the sliding subframe. Therein, a sheet conveyance guide defining a terminal lower portion of the copy sheet conveyance path and the pre-transfer charging device are separated, likewise leading to the aforedescribed drawbacks.

A pre-transfer charging device according to the present invention is provided in image processing apparatus for a xerographic image reproducing machine. The imaging apparatus comprises an imaging unit that includes a chargeable photoconductor drum photoexposable to bear an electrostatic image, and that is mounted in a first frame of the imaging apparatus installable in a xerographic image reproducing machine. The imaging apparatus further comprises a second frame fitted with a guide at least partially defining a sheet conveyance path into the imaging unit, and the first frame is pivotally joined, in a principal embodiment of the invention, to the second frame.

The pre-transfer charging device is fitted in an adjacent position between the photoconductor drum and the sheet conveyance path, and is for causing charge under a toner image developed from an electrostatic image on the photoconductor drum to disappear. The pre-transfer charging device comprises a bipartite shield having a shield upper case mounted in the first frame, and a shield lower case mounted in the second frame. A bottom exterior surface of the shield lower case serves as a guide partially defining a terminal portion of the sheet conveyance path. A discharge wire is fitted in the shield upper case, extending axially within the pre-transfer charging device, and therein is movable integrally with the shield upper case.

Further, the shield lower case is fixed through mutually engaging notched joints to a terminal portion of the guide fitted in the second frame, and the bottom exterior surface of the shield lower case and the terminal portion of the guide define a terminal portion of the sheet conveyance path adjacent the photoconductor drum.

In an alternative embodiment, the first frame is disposed as a sliding drawer within the second frame of image processing apparatus as described above, the first frame being slidably engaged into the second frame by, for example, tongue-and-groove sliding connectors.

During maintenance on an imaging apparatus embodied as in the foregoing, the first frame is separated from the second frame, the former being opened off of, or withdrawn from, the latter. The discharge wire in either case moves integrally with the shield upper case and is thus exposed for ease of cleaning and other maintenance.

Further, in either configuration the pre-transfer charger bipartite shield lower case is joined separately to the terminal portion of the copy sheet conveyance guide fitted in the second frame. The construction accordingly ensures that the accuracy of the relative positions of the parts forming the terminal portion of the sheet conveyance path is not disturbed when the frames are separated for maintenance access to the imaging apparatus. Positional accuracy in the terminal portion of the sheet conveyance path is crucial for guiding a copy sheet properly and at the right timing into image-transferring position between the photoconductor drum of the imaging unit and the image transferring device.

These and other objects, features, aspects and advantages of the present invention will become more fully apparent from the following detailed description of the present invention when taken in conjunction with the accompanying drawings, where like reference numerals denote corresponding parts throughout, in which:

DETAILED DESCRIPTION OF THE PREFERRED EMBODIMENT

Figure 1:
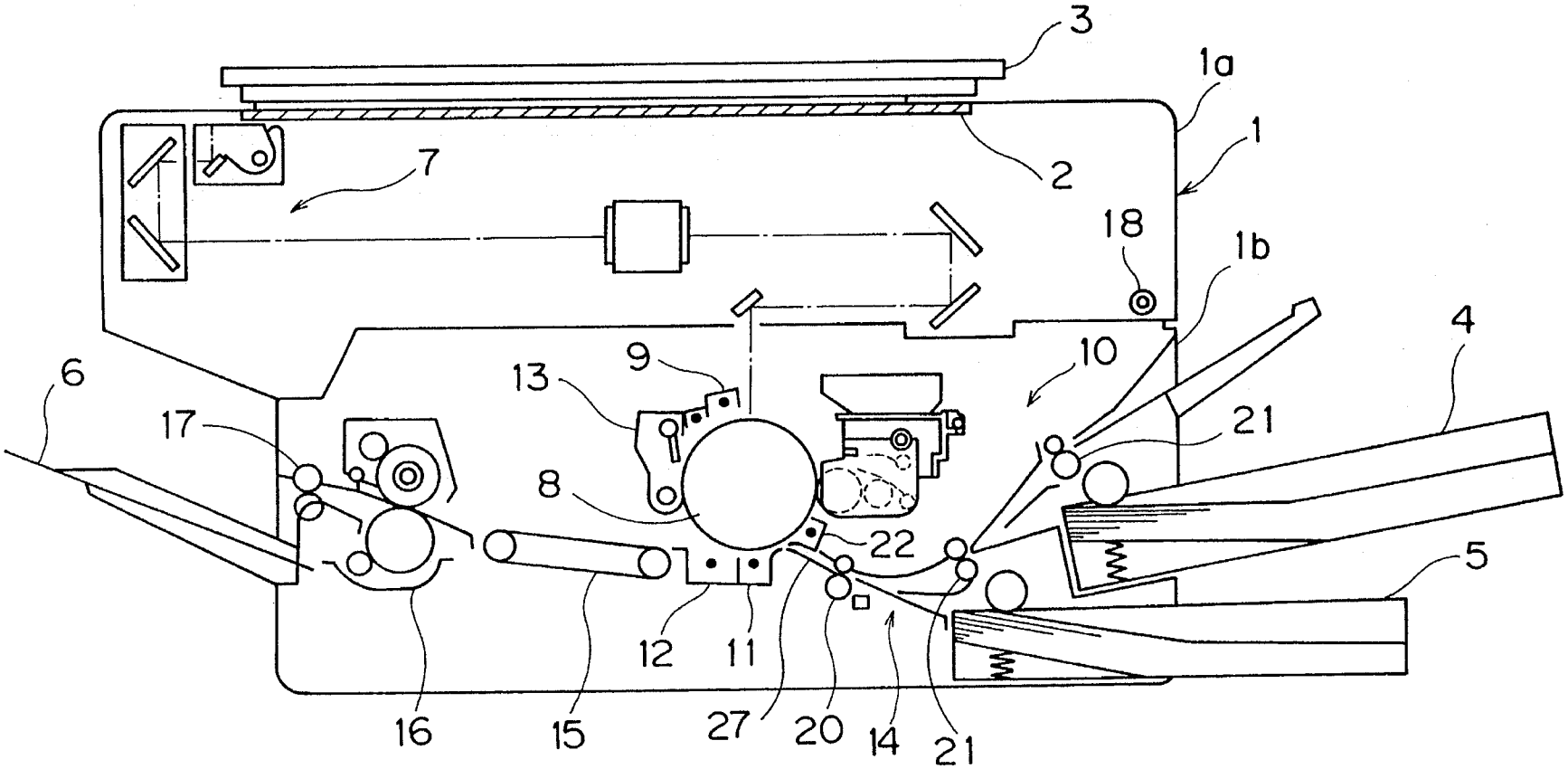
FIG. 1 is a schematic elevational cross-section of a clamshell-type xerographic photocopying machine fitted with a pre-transfer charging device embodied according to the present invention.

A xerographic photocopier furnished with a pre-transfer charging device according to an embodiment of the present invention, in reference to the FIG. 1 drawing, includes as chief components a document glass 2 secured to the top of a copier main body 1, and a document holder 3 on the document glass 2 hinged to open and close freely. Removable copy sheet supply cassettes 4 and 5 are provided on the right, in the figure, of the copier main body 1. Sheets that have passed through a xerographic copying procedure are discharged onto a sheet exit tray 6 mounted on the left, in the figure, of the copier main body 1.

An imaging apparatus within the xerographic photocopier main body 1 is located below an optical original image reader 7 consisting chiefly of a light source, a mirror and a lens unit. The imaging apparatus comprises an imaging unit, an image transferring station, and an image fixing unit. The imaging unit includes a centrally disposed photoconductor drum 8 electrostatically charged by a charging device 9 and exposed by the image reader 7 to retain superficially a latent image.

Disposed in turn around the photoconductor drum 8 following the charging device 9 are a developing device 10 of the imaging unit, for toner developing an electrostatic latent image retained on the drum 8; a transferring device 11 and a sheet separation device 12 of the image transferring station; and a cleaning device 13 also of the imaging unit.

A sheet conveyance path 14 along which copy sheets are supplied to the imaging unit is provided between the copy sheet supply cassettes 4 and 5 and the photoconductor drum 8. A toner image bearing copy sheet is discharged from the image transferring station along a sheet conveying path 15 and conveyed to a fixing device 16 of the fixing unit, wherein the toner image is fixed onto the sheet. Exit rollers 17 are located between the fixing unit and the sheet exit tray 6.

The copier main body 1 is a clamshell construction comprising main body respective upper and lower units 1*a* and 1*b* that comprise main frames holding constituent parts, enclosed in a housing. The main body upper and lower units 1*a* and 1*b* are joined on a precision hinge 18 at the main body 1 right side, in the figure. The hinge 18 accordingly enables consistent arcuate movement of the main body upper unit 1*a* with respect to the main body lower unit 1*b*.

Figure 2:
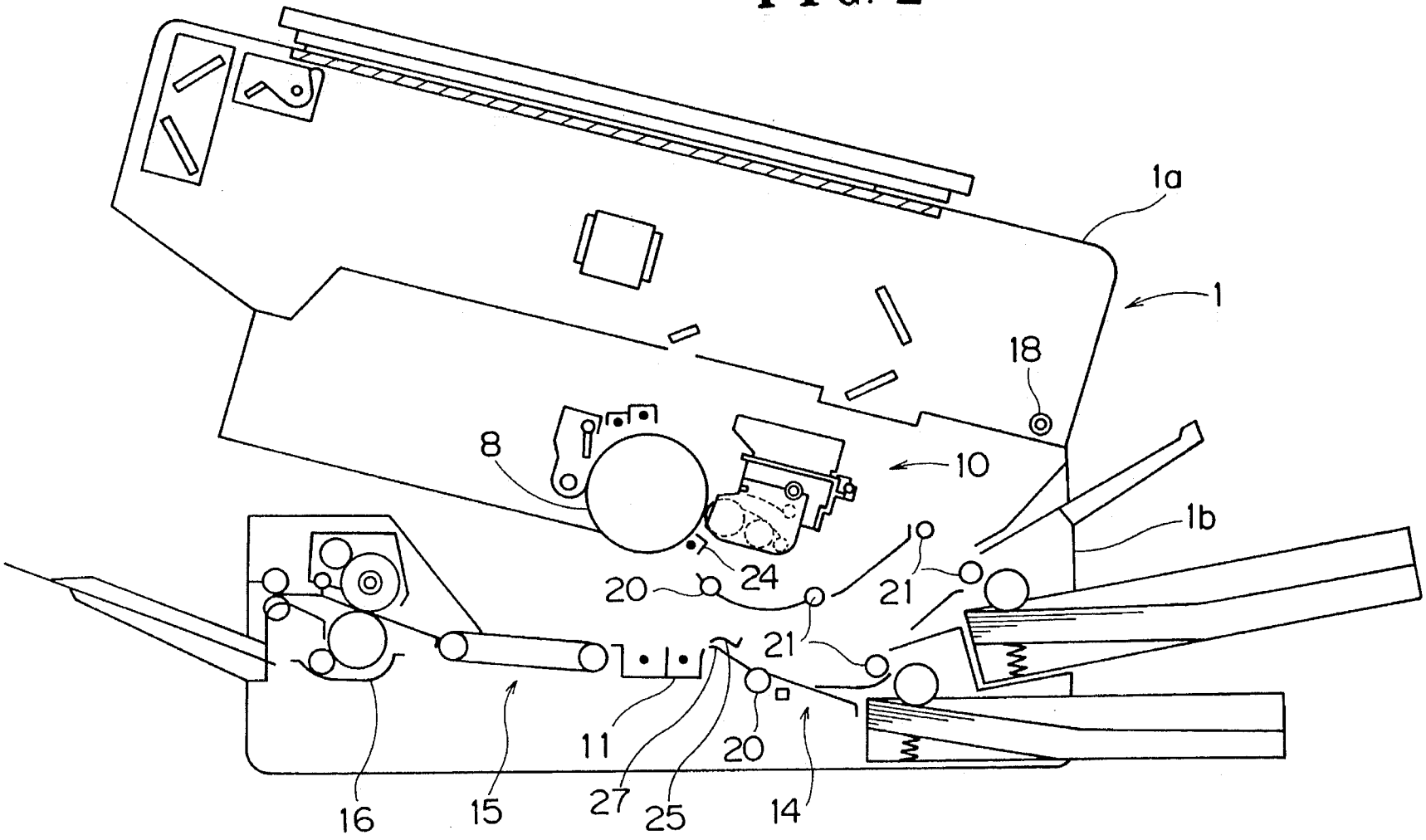
FIG. 2 is a schematic elevational cross-section, corresponding to FIG. 1, of the photocopying machine shown in an open state for performing machine internal maintenance.

FIG. 2 shows the main body upper unit 1*a*, which retains the imaging unit in a frame (not shown), opened upwards on the main body lower unit 1*b*. As is clear from FIG. 2, components located higher than the photoconductor drum 8 and the developing device 10 belong to the main body upper unit 1*a*, but these latter, as parts of the imaging unit, belong to the main body upper unit 1*a* as well. The image transferring station, as indicated in FIG. 2 by the transfer device 11, as well as the fixing unit, indicated by the fixing device 16 in the figure, likewise belong to the main body lower unit 1*b*.

The sheet conveyance path 14 is defined chiefly by upper and lower guide plates separated by a gap. A pair of resist rollers 20 for conveying copy sheets to the imaging unit at a prescribed timing are located near the end of the sheet conveyance path 14 toward the imaging unit/image transferring station. Further, two pairs of supply rollers 21 are located in the sheet conveyance path 14 upstream of the resist rollers 20. The upper portion of the sheet conveyance path 14, with the exception of a terminal portion adjacent the image transferring station (as will be explained below), as well as the upper of the roller pairs 20 and 21, belongs to the main body upper unit 1*a*. The path 14 lower portion, together with the lower of the roller pairs 20 and 21, belongs to the main body lower unit 1*b*.

Figure 3:
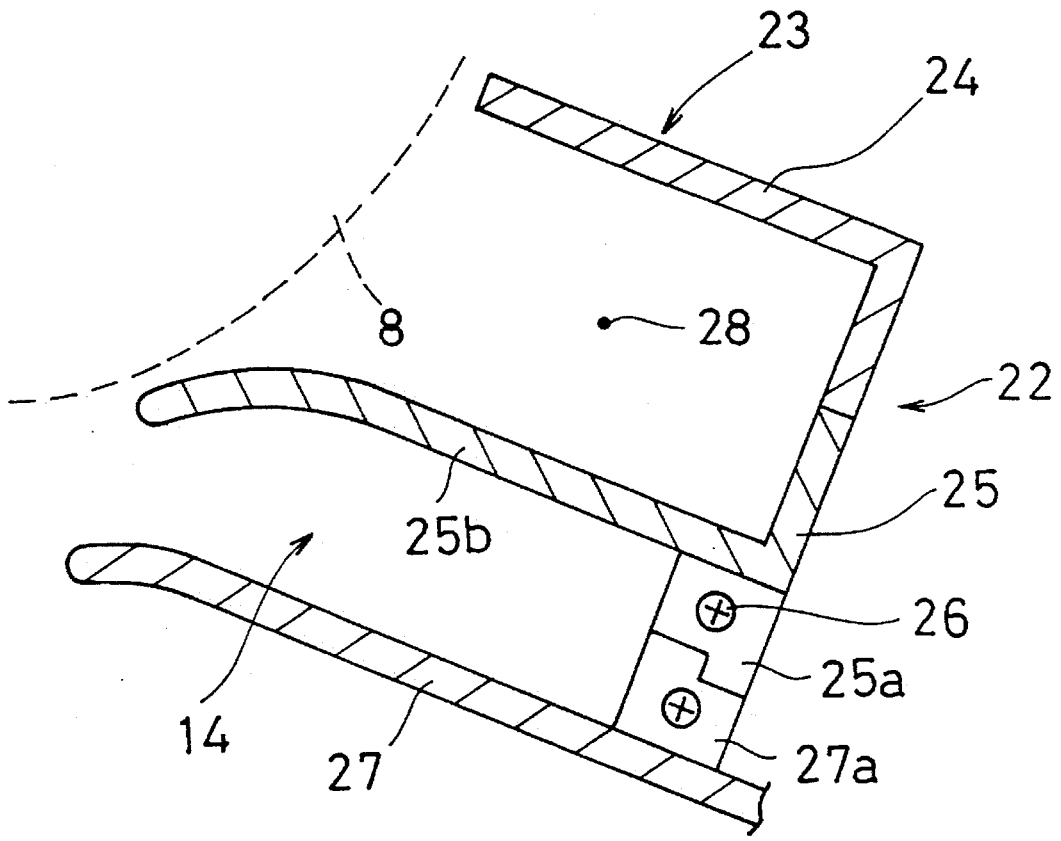
FIG. 3 is an enlarged fragmentary cross-section of a discharge wire shield case of the pre-transfer charging device, as it would appear when the clamshell-type photocopying machine is in an operational or closed state, wherein the position of an adjacent photoconducting drum is partially indicated in phantom.

As FIG. 1 illustrates, the pre-transfer charging device 22 is disposed along the upper terminal portion of the sheet conveyance path 14 adjacent the photoconductor drum 8 of the imaging unit. The pre-transfer charging device 22, for causing charge under a toner-developed image superficially retained on the photoconductor drum 8 to disappear, as shown in FIG. 3, chiefly comprises an electrically conductive shield case 23 and a discharge wire 28. The shield case 23 is in cross section roughly a reverse (in the FIG. 3 orientation) "C". Therein the shield case 23, fitted extending in the front-to-rear direction of the copier, opens on the cylindrical surface of the photoconductor drum 8, generally parallel to its axis. The discharge wire 28 is fitted approximately in the center of the shield case 23, also extending in the front-to-rear direction.

The shield case 23 is composed of a shield upper case 24, L-shaped in cross-section, and a shield lower case 25, roughly an "L" in cross-section likewise. A notched mount 25*a* of the shield lower case 25 is fixed to the main body lower unit 1*b* by means of a screw 26. The exterior of a lower wall 25*b* of the shield lower case 25 defines an upper terminal portion of the sheet conveyance path 14. The downstream end of the lower wall 25*b* is accordingly curved toward the transfer device 11.

A guide plate 27 opposite the lower wall 25*b* of the shield lower case 25 defines a lower terminal portion of the sheet conveyance path 14. A notched mount 27*a* is likewise provided on the guide plate 27, and the notched mounts 27*a* and 25*a* engage mutually in order to maintain a prescribed vertical spacing between the guide plate 27 and the lower wall 25*b* of the shield lower case 25. Accordingly, the guide plate 27 and the lower wall 25*b* together terminally guide a copy sheet conveyed along the sheet conveyance path 14 into image-transferring position between the photoconductor drum 8 and the transfer device 11.

The shield upper case 24 is secured to the main body upper unit 1*a* and the discharge wire 28 is attached to the shield upper case 24. Thus the shield upper case 24 in assembly with the discharge wire 28 moves integrally with the main body upper unit 1*a* when it is opened or closed on the main body lower unit 1*b*.

The main body upper unit 1*a* and the main body lower unit 1*b* according to this embodiment ordinarily are joined for copying operation, as shown in FIG. 1. Joined accordingly, the shield upper and lower cases 24 and 25 of the pre-transfer charging device 22 integrally constitute a shield case 23, wherein the exterior of the lower wall 25*b* of the shield lower case 25 forms an upper terminal portion of the sheet conveyance path 14.

In a general xerographic photocopying operation, in terms of the involvement of the pre-transfer charging device 22 embodied as in the foregoing, an original document placed on the document glass 2 is scanned by the exposure device 7, which thereby derives image information and correspondingly exposes the electrostatically charged cylindrical surface of the photoconductor drum 8. The electrostatic latent image is developed by the developing device 10, forming a toner image superficially retained on the photoconductor drum.

A sheet supplied from the copy sheet supply cassettes 4 or 5 is meanwhile conveyed via the copy sheet conveyance path 14 and the resist rollers 20 to the lower wall 25*b* of the shield lower case 25 and is thus guided toward the transfer device 11.

The pre-transfer charging device 22 then operates to cause charge under the toner image formed on the photo-conductor drum 8 to disappear, accordingly improving the efficiency with which the transfer device 11 subsequently transfers the toner image on the photoconductor drum 8 onto the sheet.

A copy sheet onto which a toner image has been transferred, after being subjected to a fixing process in the fixing device 16, is discharged into the exit tray 6.

When maintenance operations are to be carried out, the main body upper unit 1*a* is swung opened upwards as shown in FIG. 2, pivoting on the hinge 18. In such an instance, the shield upper case 24 of the shield case 23 swings in tandem upwards with the main body upper unit 1*a*, whereas the shield lower case 25 remains in the main body lower unit 1*b*. Swinging up the main body upper unit 1*a*, therefore, separates the shield case 23, exposing the discharge wire 28 within the shield upper case 24 for facilitated cleaning.

The discharge wire 28 together with the shield upper case 24 in this configuration moreover moves integrally with the main body upper unit 1*a* holding the photoconductor drum 8, wherein accuracy of position between the discharge wire 28 and the photoconductor drum 8 is not disrupted.

Further, since the shield lower case 25 having the lower wall 25*b* is mounted together with the guide plate 27 in the main body lower unit 1*b*, the accuracy of positioning and vertical spacing between the upper and lower guides defining the terminal portion of the sheet conveyance path 14 is not disturbed during maintenance, as these parts do not move relative to each other when the clamshell photocopier is split open.

Figure 4:
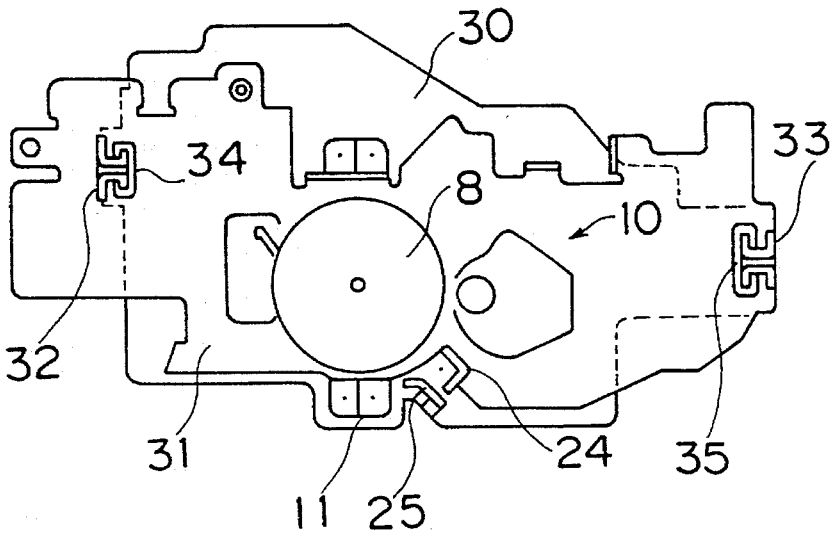
FIG. 4 is a schematic elevational view of an image processing apparatus, mounted in a drawer frame for a xerographic image reproducing machine and fitted with a pre-transfer charging device according to another embodiment of the present invention.

The present invention can also be applied to an imaging apparatus construction, illustrated in FIG. 4, for a xerographic copier provided with a sliding drawer frame 31 that is slidable (by means of tongue and groove fittings, for example), in the front-to rear direction of the machine with respect to a fixed frame 30 housed in the photocopier main body.

Guide tongues 32 and 33 are provided in the left and right sides of the fixed frame 30, engaged with sliding groove guides 34 and 35, such that the sliding frame 31 is slidably withdrawn from and retracted into the fixed frame 30.

A photoconductor drum 8, a developing device 10, etc. of an imaging unit, together with the shield upper case 24, are fitted in the sliding frame 31. Herein, a transfer device 11 and the shield lower case 25 are secured to the fixed frame 30.

For operation of a xerographic copier embodying an assembly as in the foregoing, the sliding frame 31 is housed retracted in the fixed frame 30, whereby the shield upper case 24 and the shield lower case 25 are coupled. Accordingly, the shield upper case 24 and the shield lower case 25 compose a functionally integral shield case 23. The shield case 23, together with a discharge wire provided centrally extending within the shield upper case 24, constitutes a pre-transfer charging device 22.

Figure 5:
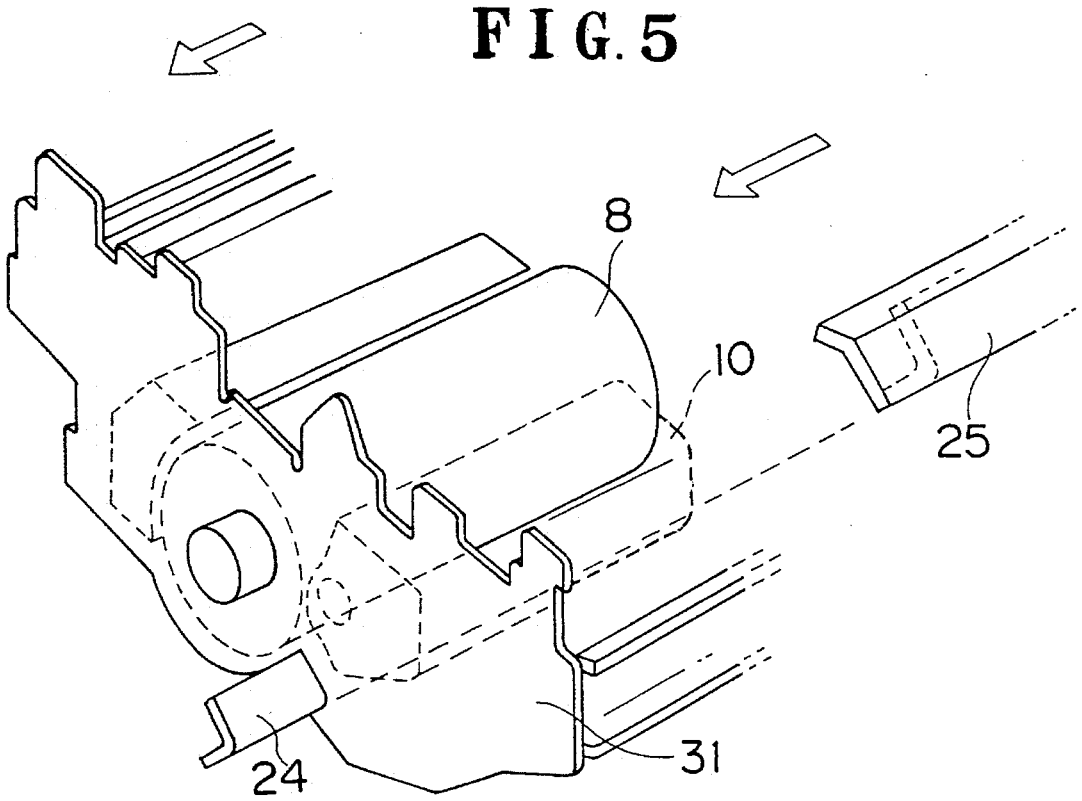
FIG. 5 is an axonometric view of the imaging unit of FIG. 4, with portions of the drawer frame shown partially and by hidden lines, wherein the imaging unit is shown withdrawn in the direction of the arrows for performing xerographic machine internal maintenance.

As shown in FIG. 5, during maintenance the sliding frame 31 is pulled forwards (in the direction of the arrows in the figure) from the fixed frame 30 on the sliding groove guides 34 and 35, guided by the guide tongues 32 and 33. Accordingly, the shield upper case 24 containing the discharge wire is withdrawn together with the sliding frame 31, exposing the discharge wire for ease of cleaning.

The bottom exterior surface of the shield lower case 25 likewise serves, as in the embodiment just described, as the upper terminal portion of a copy sheet supply path (not shown in either of the figures). Therein, during maintenance when the sliding frame 31 is pulled forwards, the shield lower case 25 remains in the fixed frame 30, ensuring that accuracy of position is maintained between the bottom of the shield lower case 25 and a guide in the copier main body (again, not shown) forming the terminal portion of the copy sheet supply path.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An image processing apparatus for a xerographic image reproducing machine, comprising:

an imaging unit including a chargeable photoconductor drum photoexposable to bear an electrostatic image;

a first frame installable in a xerographic image reproducing machine, for retaining said imaging unit;

a second frame installable in said xerographic image reproducing machine, fitted with a lower guide at least partially defining a sheet conveyance path into said imaging unit;

connecting means for connecting said first frame and said second frame so as to be movable relative to each other;

a pre-transfer charging device fitted in an adjacent position between said photoconductor drum and said sheet conveyance path, for causing charge under a toner image developed from an electrostatic image on said photoconductor drum to disappear, said pre-transfer charging device including a pre-transfer charger bipartite shield comprising a shield upper case mounted in said first frame, and a shield lower case mounted in said second frame, said shield lower case having a wall exterior surface serving as an upper guide partially defining a terminal portion of said sheet conveyance path; and a discharge wire disposed within said pre-transfer charger bipartite shield.

2. The image processing apparatus according to claim 1, wherein said discharge wire is fitted within said shield upper case of said pre-transfer charger bipartite shield so as to be movable integrally with said shield upper case.

3. The image processing apparatus according to claim 1, wherein said shield lower case is fixed through at least a joint to a terminal portion of said lower guide; and said wall exterior surface of said shield lower case and said terminal portion of said lower guide define a terminal portion of said sheet conveyance path adjacent said photoconductor drum.

4. The image processing apparatus according to claim 1, wherein said first frame is disposed above said second frame; and said connecting means pivotally joins said first frame to said second frame.

5. The image processing apparatus according to claim 2, wherein said first frame is disposed above said second frame; and said connecting means pivotally joins said first frame to said second frame.

6. The image processing apparatus according to claim 1, wherein said first frame is disposed within said second frame; and said connecting means includes a slider and a corresponding guide element joining said first frame into said second frame.

7. The image processing apparatus according to claim 2, wherein said first frame is disposed within said second frame; and said connecting means is a sliding pair joining said first frame into said second frame.

8. The image processing apparatus according to claim 1, wherein said pre-transfer charger bipartite shield is made of metal.

* * * * *